US007974554B2

(12) United States Patent
Schleusener

(10) Patent No.: US 7,974,554 B2
(45) Date of Patent: Jul. 5, 2011

(54) METHOD FOR IMPRINTING A RECORDING MEDIUM

(75) Inventor: Martin Schleusener, Namborn (DE)

(73) Assignee: Oce Printing Systems GmbH, Poing (DE)

( * ) Notice: Subject to any disclaimer, the term of this patent is extended or adjusted under 35 U.S.C. 154(b) by 1076 days.

(21) Appl. No.: 10/590,161

(22) PCT Filed: Feb. 24, 2005

(86) PCT No.: PCT/EP2005/001964
§ 371 (c)(1),
(2), (4) Date: May 24, 2007

(87) PCT Pub. No.: WO2005/083528
PCT Pub. Date: Sep. 9, 2005

(65) Prior Publication Data

US 2007/0217824 A1 Sep. 20, 2007

(30) Foreign Application Priority Data

Mar. 1, 2004 (DE) ..... 10 2004 009 987

(51) Int. Cl.
*G03G 15/10* (2006.01)

(52) U.S. Cl. ..... 399/231

(58) Field of Classification Search ..... 399/237–239, 399/251, 335, 336
See application file for complete search history.

(56) References Cited

U.S. PATENT DOCUMENTS

| | | | | |
|---|---|---|---|---|
| 4,259,429 | A | 3/1981 | Gilliams et al. | |
| 5,364,726 | A | 11/1994 | Morrison et al. | |
| 6,539,191 | B2 * | 3/2003 | Itaya | 430/45.2 |
| 2005/0074260 | A1 * | 4/2005 | King et al. | 399/222 |

FOREIGN PATENT DOCUMENTS

| | | |
|---|---|---|
| EP | 0 727 720 | 12/2000 |

(Continued)

OTHER PUBLICATIONS

WPI/Derwent XP-002333455-1992-223848.

*Primary Examiner* — David M Gray
*Assistant Examiner* — Erika Villaluna
(74) *Attorney, Agent, or Firm* — Schiff Hardin LLP

(57) ABSTRACT

In a method or system for printing of a recording medium, potential images are generated on a potential image carrier. A developer liquid is used that comprises a transparent photo-polymerizable carrier liquid and charged colorant particles. The developer is transported via an applicator roller to the potential image carrier to form a developer film in a developing zone. The developer film adjacent to the potential image carrier comprises the photo-polymerizable carrier liquid enriched with the colorant particles in regions in which potential images are present on the potential image carrier and said photo-polymerizable liquid substantially depleted of said colorant particles in regions in which no potential images are present. The developer film splits at an end of the developing zone into an image film adhering to the potential image carrier comprising the developed potential image and a film adhering to the applicator roller comprising the photo-polymerizable liquid with residual colorant particles. The image film with the developed potential images is transferred from the potential image carrier onto the recording medium such that the colorant particles and a portion of the photo-polymerizable liquid in which the colorant particles are arranged migrates from the image film. The image film is fixed on the recording medium with a radiation such that the colorant particles of the developed potential images are embedded in a solid, transparent polymer mass via photo-polymerization, and otherwise the photo-polymerizable liquid is solidified into a transparent film.

38 Claims, 2 Drawing Sheets

FOREIGN PATENT DOCUMENTS

| | | | | |
|---|---|---|---|---|
| EP | 0 756 213 | | | 12/2002 |
| JP | 04151674 | A | | 5/1992 |
| JP | 10073997 | A | * | 3/1998 |
| JP | 2000198570 | A | * | 7/2000 |
| JP | 2003057883 | A | | 2/2003 |

* cited by examiner

METHOD FOR IMPRINTING A RECORDING MEDIUM

BACKGROUND

For single- or multi-color printing of a recording medium, for example of a single sheet or of a belt-shaped recording medium made from the most varied materials (for example plastic, paper or thin metal foils), it is known to generate image-dependent potential images (charge images) on a potential image carrier (for example a photoconductor), to ink these potential images in a developer station (inking station) and to transfer-print the image so developed onto the recording medium.

Either dry toner or liquid developer can thereby be used to develop the potential images.

A method for electrophoretic liquid development (electrographic developing) in digital printing systems is, for example, known from EP 0 756 213 B1 or EP 0 727 720 B1. The method described there is also known under the name HVT (high viscosity technology). A carrier fluid comprising silicon oil with ink particles (toner particles) dispersed therein is thereby used as a developer fluid. The toner particles typically have a particle size of less than 1 micron. Something close to this can be learned from EP 0 756 213 B1 or EP 0 727 720 B1, which are components of the disclosure of the present application. Described there are electrophoretic liquid developing methods of the cited type with silicon oil with toner particles dispersed therein as a carrier fluid and additionally a developer station made up of one or more application rollers for wetting the potential image carrier (developer roller) with liquid developer corresponding to the potential images on the potential image carrier. The developed potential image is then transferred onto the recording medium via one or more transfer rollers.

In order to secure the toner images in the recording medium, these are fixed in a fixing station.

The disadvantages of the known fixing methods are to be seen in the following points:

1.) Dry Toner Printing:

Here thick toner layers are used, therefore a high fixing energy requirement is required with significant paper stress given heat fixing or heat/pressure fixing; the abrasion of fixed dry toner layers in the printer and in the post-processing is frequently problematic.

2.) Liquid Toner on the Basis of Volatile Carrier Fluids:

The carrier fluid is afflicted with odor and flammable, residues of carrier fluid remain on the recording medium, the evaporation time lies in the range of multiple seconds or, respectively, minutes, tendency to smear exists.

3.) Liquid Toner, Water-Based:

Danger of the discharge of an electrostatic charge image in contact with the conductive liquid exists (U.S. Pat. No. 5,943,535), evaporation of the residual water on the recording medium is not possible in very short time spans given temperatures that are not too high, the optimization with regard to complete transfer is problematic.

4.) Liquid Toner, Silicon Oil-Based:

Fixing on non-porous or non-silicon oil-absorbing substrates is problematic.

5.) Conventional Printing Methods:

No variable print form is possible, the edition 1 or low print run is uneconomical.

SUMMARY

It is an object to specify a method with which a fast-drying, highly abrasion-resistant printing of variable data or of print runs of smaller and medium volume on the basis of a potential image is possible.

In a method or system for printing of a recording medium, potential images are generated on a potential image carrier. A developer liquid is used that comprises a transparent photo-polymerizable carrier liquid and charged colorant particles. The developer is transported via an applicator roller to the potential image carrier to form a developer film in a developing zone. The developer film adjacent to the potential image carrier comprises the photo-polymerizable carrier liquid enriched with the colorant particles in regions in which potential images are present on the potential image carrier and said photo-polymerizable liquid substantially depleted of said colorant particles in regions in which no potential images are present. The developer film splits at an end of the developing zone into an image film adhering to the potential image carrier comprising the developed potential image and a film adhering to the applicator roller comprising the photo-polymerizable liquid with residual colorant particles. The image film with the developed potential images is transferred from the potential image carrier onto the recording medium such that the colorant particles and a portion of the photo-polymerizable liquid in which the colorant particles are arranged migrates from the image film. The image film is fixed on the recording medium with a radiation such that the colorant particles of the developed potential images are embedded in a solid, transparent polymer mass via photo-polymerization, and otherwise the photo-polymerizable liquid is solidified into a transparent film.

DESCRIPTION OF A PREFERRED EMBODIMENT

Figure 1:
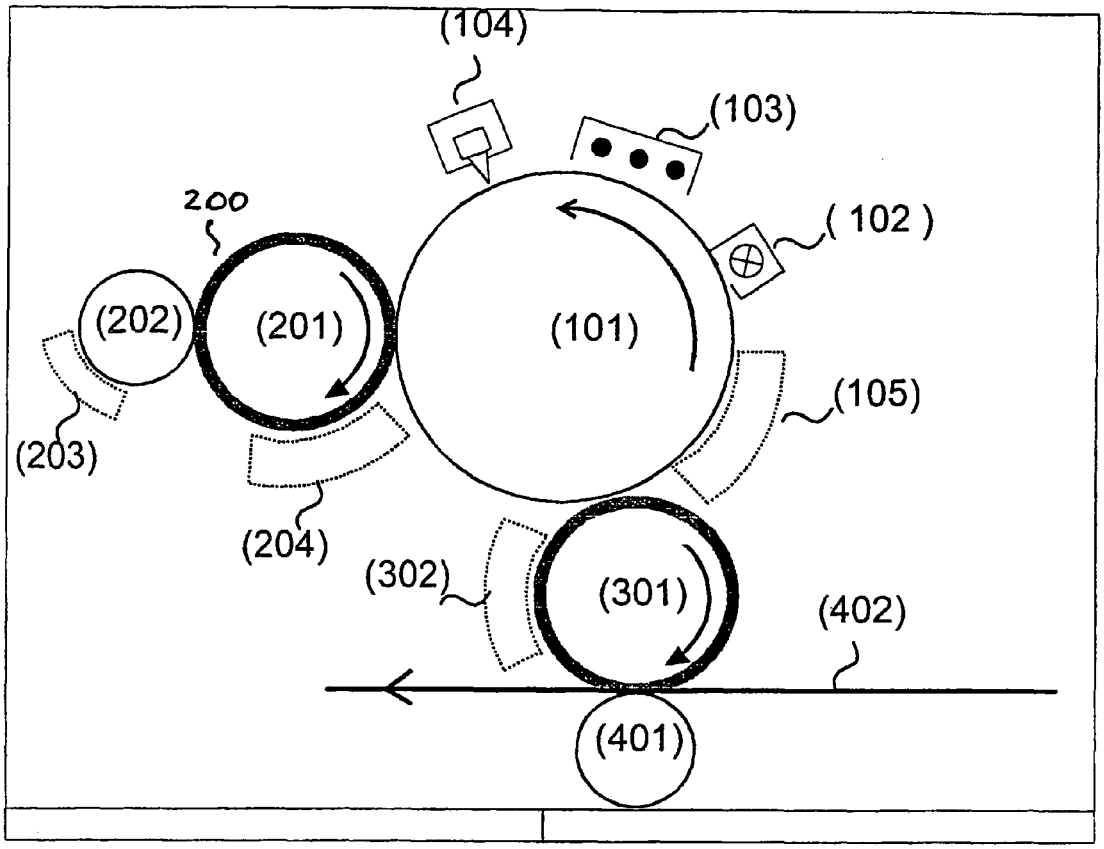
FIG. 1 is a principle representation of a printer or copier device with which the method can be implemented.

The preferred embodiment solves the specified technical problem via use of liquid, UV-curable colorants that form a very thin pigment film and function in principle like electrophoretic methods, whereby charged pigment particles in a photo-polymerizable liquid are deposited according to the image via the effect of an electrostatic potential image and the pigment image, with a residual portion of the UV-curable liquid, is hardened on the recording medium via UV exposure.

In the following the photo-polymerizable liquid is called carrier fluid.

In order to achieve curing, a high-ohmic photo-polymerizable carrier fluid (for example acrylester) is used in which color pigments, coated color pigments or toner particles with color pigments or dyes are suspended (called solid particles in the following). Moreover, further substances (such as charge control substances that charge suspended particles in a targeted manner, initiators that accelerate the photo-polymerization of the carrier fluid as well as surface tension-influencing and viscosity-controlling agents) can be added to the photo-polymerizable liquid. A high solid proportion of over 10% is advantageously used. The composition of the carrier fluid and of the solid particles suspended therein is adjusted such that the solid particles in the carrier fluid charge with a preferred polarity.

In the following the carrier fluid is called FPFE (photo-polymerizable liquid developer).

In an inking station (developer station) the FPFE is prepared such that a carrier fluid quantity that is constant per time unit and per surface is present on an applicator roller. On this applicator roller the FPFE is conveyed into the effective region of a potential pattern on the potential image carrier, for example a photoconductor. The potential pattern was generated on the potential image carrier beforehand via suitable means, for example via a typical electrophotographic process.

A bias voltage can be applied to the applicator roller such that a potential contrast results between the image points of the potential pattern on the potential image carrier and the bias voltage. The bias voltage can also contain AC components in addition to DC components.

A uniform FPFE film can be located in a contact zone between applicator roller and potential image carrier. In the electrical field of the potential image between potential image carrier and applicator roller, the solid particles are deposited (according to the image) on the potential image carrier corresponding to their preferred charge. Given the separation of the FPFE film at the end of the contact zone, the solid particles forming the image to be printed in the region of the image surfaces are located in direct proximity to the surface of the potential image carrier. In the regions that are not to be inked, the solid particles are found at a greater distance from the potential image carrier surface, preferably in proximity to the surface of the applicator roller.

At the moment of the separation of the FPFE film from the potential image carrier, the imaging solid particles are thus located in the part of the liquid film that moves along further with the potential image carrier. The surfaces of the film adhering to the potential image carrier that are not to be inked are free or nearly free of solid particles. The liquid layer adhering on the potential image carrier thereby comprises a thin, transparent photo-polymerizable layer that contains an image comprised of solid particles. The liquid layer that contains the color image comprised of solid particles is called an image film in the following.

In the subsequent step the color image can preferably be transferred from the potential image carrier onto a recording medium (printing substrate) with the assistance of an electrical field. The image film is thereby in turn separated in the same manner as it has been described above for the separation process at the end of the developing process. This means that the solid particles are completely or almost completely transferred onto the recording medium and the transparent photo-polymerizable layer is only partially (approximately 50%) transferred onto the recording medium. It is likewise possible to first transfer the pigment image from the potential image carrier onto an intermediate image carrier (printing blanket, transfer printing roller) and subsequently onto a recording medium. The same electrostatically-supported method can hereby be used as it has already been described above for the transfer of the potential image carrier onto an recording medium.

A reduction of the proportion of photo-polymerizable carrier fluid in the image film (and therewith reduction of unwanted background) can occur at various points in the printing process:

The liquid portion in the image film can, for example, be reduced on the potential image carrier, on an intermediate image carrier or on the recording medium. This can, for example, occur via a removal roller that is brought into direct contact with the image film, whereby an electrical auxiliary field can be applied such that the solid particles with the correct preferred charge are moved away from the removal roller and the (possibly present) incorrectly charged solid particles are moved towards the removal roller. After the separation process a liquid film can result on the removal roller that exhibits approximately 50% of the liquid film thickness of the image film before the contact with the removal roller and predominantly comprises only some incorrectly-charged solid particles. The image film is on the one hand relieved of a portion of the carrier fluid and on the other hand of possibly-present, incorrectly-charged solid particles that would otherwise lead to adverse background effects on the image-free areas on the recording medium.

Given multi-color printing, the various color image separations are generated in succession on the potential image carrier and are transferred in succession onto an intermediate image carrier or onto the recording medium. The color image separations can also be collected directly on the potential image carrier and then transferred together onto the recording medium, or they can be individually transferred from the potential image carrier onto the intermediate carrier and collected on this and then be transferred onto the recording medium.

The print image is fixed on the recording medium via exposure with UV light. Via photo-polymerization of the transparent carrier fluid the solid particles are on the one hand embedded in a solid polymer matrix, and on the other hand the carrier fluid permanently bonds with the recording medium. The carrier fluid in the non-image regions is hardened into a thin, transparent film. Given porous or absorbent recording media, the transparent, photo-polymerizable liquid can penetrate into the recording media. Given UV exposure it is then solidified in the recording medium.

In the tuning of chemical processes spectral distribution and power density of the exposure are to be taken into consideration for the exposure of the recording medium:

Individually, the process of the UV curing can be optimized via the correct spectral distribution and the correct power density of the radiation;

A radiation source can normally be used that radiates a combination of ultraviolet light (wavelength: 200 to 400 nm, identification code: UV), visible light (wavelength: 400 to 700 nm, identification code: VIS), and infrared light (wavelength: 700 to 10 μm, identification code: IR). The relative proportion of these spectral ranges is thereby selected such that, in adaptation to the chemical composition of the photo-polymerizable carrier fluid, the IR/VIS components are used for the activation of the bonds necessary for photo-polymerization (heating) and the UV component is used for curing of the photo-polymerizable carrier fluid. Both the relative proportions of the spectral ranges as well as the absolute power density of the radiation must be adapted to the chemical properties of the corresponding substances, to the thickness of the layer to be polymerized and to the process speed of the printing and fixing process.

A fine gradation of the fixing process, an influencing of the gloss and of the abrasion resistance of the print image can be implemented with the following measures:

Via targeted usage of specific UV wavelength ranges the fixing quality, the gloss and the abrasion resistance of the print image can be adapted corresponding to the desired properties of the print image and to the load to be expected of the print image in a specific post-processing line.

The UV-A radiation (wavelength: 320 to 400 nm) has a greater penetration depth and effects a stronger volume effect, i.e. a polymerization of the entire slice volume.

The UV-B radiation (wavelength: 280 to 320 nm), as a result of lesser penetration depth, effects a more significant curing of the material on the surface than inside the recording medium.

The UV-C radiation (wavelength: 200 to 280 nm) is used for surface curing.

The usage of inert gas (for example nitrogen) leads to intensified surface curing.

A corona exposure before and/or during the UV curing leads to reduced surface polymerization of the recording medium, which can be used, for example, to avoid a too-severe brittleness of the surface and to better elasticity in the post-processing.

A good liquefaction of the image film and a good bonding with the surface of the recording medium given a high surface gloss can be achieved via the suitable combination of corona effect, IR/VIS and UV-A radiation in a first fixing step. This can in particular be required given non-porous recording media such as smooth polymer films or metal films. If a hard surface is desired, it can be subsequently cured with UV-C radiation.

Given the fixing in multi-color printing the following considerations are important:

Given multi-colored printing, depending on the requirement a printed color separation can be fixed immediately, meaning before the transfer of the next color separation onto the recording medium. A complete fixing of the entire image that comprises a plurality of color separations can also occur.

It is also possible to generate individual color separations with particular gloss or abrasion properties in that these color separations are subjected to a separate fixing treatment and/or to a specific corona pre-treatment.

In order to obtain specific gloss or matte properties, a UV pre-fixing of reduced power density with subsequent roller stamping with specific surface roughness and an end fixing to achieve the sufficient solidity and hardness is also possible.

Given intermediate fixing or to increased viscosity or for transfer to very thick recording media, the following advantageous steps can be implemented:

In the variants described above, given use of reduced exposure power the UV exposure can also be used to increase the viscosity of the image film in any stage of the printing process. For example, to assist the transfer printing of the image film onto a very thick recording medium (given which an electrostatic transfer printing assistance also meets with difficulty), the viscosity of said image film is increased such that the entire image film can be transferred from an intermediate image carrier with low surface energy (for example Teflon) onto the thick recording medium (for example thick cardboard, wood or the like) via contact pressure.

Such a process can be optimized in that a corona pretreatment is utilized in combination with UV-A curing, whereby an image film that is contiguous in volume with the adhesive surface is generated which leads to a complete transfer of the image film with adhesion onto the recording medium.

A UV-A/B post-fixing leads to sufficient adhesion and stability of the image film on the recording medium.

A principle representation of an electrographic printing device results from FIG. 1. A potential image carrier 101 (for example a photoconductor drum) is initially exposed to a discharge exposure 102. The charging of the potential image carrier 101 subsequently occurs in the station 103. Potential images of images to be printed are generated on the potential image carrier 101 via exposure according to the image in the station 104. These potential images are developed in a developer station 200 by a liquid developer with the aforementioned properties. For this liquid developer is extracted from a developer reservoir 203 and supplied to an applicator roller 201 via an application roller 202. The applicator roller 201 conveys the liquid developer to the potential image carrier 101. The applicator roller 201 is subsequently cleaned in the cleaning station 204.

Given the development of the potential images on the potential image carrier 101, carrier fluid with solid particles migrates to the potential image carrier 101 and deposits there in the image regions; and carrier fluid is transferred to the potential image carrier 101 in the non-image regions. In a film that comprises carrier fluid with toner particles in the image regions, carrier fluid in the non-image regions thus forms on the potential image carrier 101.

With an intermediate carrier 301 the film is transferred onto a recording medium 402 in a transfer printing station. Another counter-pressure roller 401 is used for this. The intermediate carrier 301 can additionally be cleaned with the aid of an intermediate carrier cleaning 302.

Figure 2:
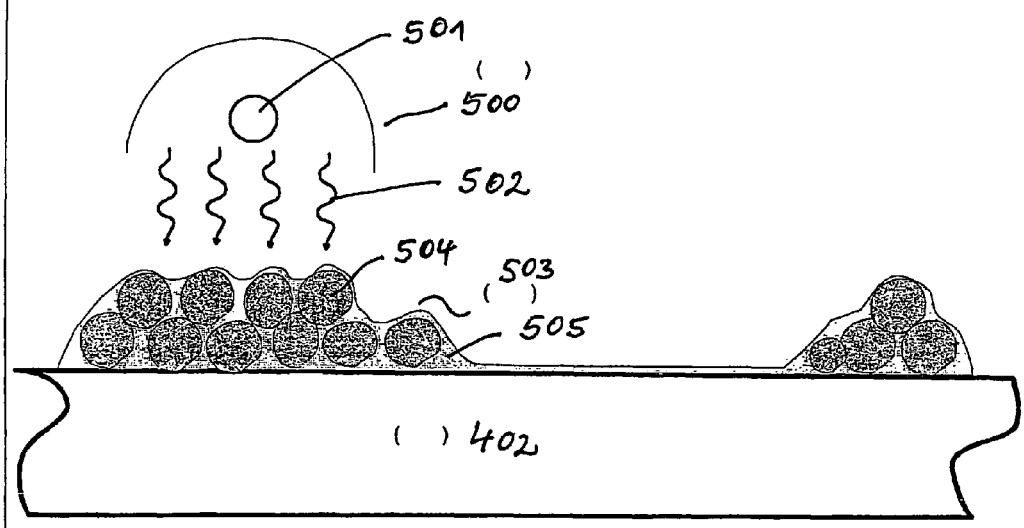
FIG. 2 shows the fixing in principle representation.

The recording medium 402 is finally supplied to a fixing station 500 in which the fixing occurs according to the method stated above. The workflow of the fixing results from FIG. 2. The fixing station 500 comprises a radiation source 501 that emits the aforementioned UV radiation 502. The radiation 502 is directed onto the recording medium 402 and there impinges on the film 503 that comprises the print images. The film comprises the toner particles 504 and the carrier fluid 505. Via the radiation 502 the film 503 is bonded with the recording medium 402 according to the method illustrated above.

If excess carrier fluid on the recording medium 402 or an intermediate carrier 301 should be removed, this can, for example, occur in the following manner:

via a removal roller that is located in contact with an intermediate carrier and/or recording medium, via a removal roller that exhibits a potential such that the charged solid particles are repelled from this removal roller and only the carrier fluid is split up;

the carrier fluid transferred to a non-absorbent removal roller can, for example, be removed by a scraper;

if the removal roller exhibits an absorbent coating, the transferred carrier fluid can, for example, be removed via a nip bar.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

I claim as my invention:

1. A method for printing of a recording medium, comprising:

generating potential images of images to be printed on a potential image carrier;

to develop the potential images, using a liquid developer that comprises a transparent photo-polymerizable carrier liquid and charged colorant particles suspended therein;

transporting the developer via an applicator roller to the potential image carrier in a quantity that is substantially constant per time and area to form a developer film in a developing zone between the potential image carrier and the applicator roller for development of the images, the developer film adjacent to the potential image carrier comprising said photo-polymerizable carrier liquid enriched with said colorant particles in regions in which potential images are present on the potential image carrier and comprising said photo-polymerizable liquid substantially depleted of said colorant particles in regions in which no potential images are present, the developer film splitting at an end of the developing zone into an image film adhering to the potential image carrier comprising the developed potential images and a film adhering to the applicator roller comprising said photo-polymerizable liquid with residual colorant particles;

transferring a portion of the image film with the developed potential images from the potential image carrier onto the recording medium such that the colorant particles and a portion of the photo-polymerizable liquid in which the colorant particles are arranged migrates from the image film; and fixing on the recording medium with a UV radiation a first part of the portion of the image film with the potential images to be developed such that the colorant particles of the developed potential images are embedded in a solid, transparent polymer mass via photo-polymerization, and otherwise the photo-polymerizable liquid in a second part of the portion of the image film without the potential images is solidified into a transparent film.

2. A method according to claim 1 in which the photo-polymerizable liquid is high-ohmic.

3. A method according to claim 1 in which the photo-polymerizable liquid comprises acrylester.

4. A method according to claim 1 in which the charged colorant particles comprise solid particles in the photo-polymerizable liquid.

5. A method according to claim 4 in which charge control substances that influence the charging of the suspended colorant particles is added to the photo-polymerizable liquid.

6. A method according to claim 4 in which initiators that accelerate the photo-polymerization of the liquid are added to the photo-polymerizable liquid.

7. A method according to claim 4 in which surface tension-influencing and viscosity-controlling agents are added to the photo-polymerizable liquid.

8. A method according to claim 4 in which a proportion of the colorant particles in the liquid developer is >10%.

9. A method according to claim 4 in which a composition of the photo-polymerizable liquid and of the colorant particles suspended therein is selected such that the solid particles in the photo-polymerizable liquid charge with a preferred polarity.

10. A method according to claim 4 in which a bias voltage is applied to the applicator roller such that a transition of the colorant particles of the liquid developer into the image regions of the potential image carrier is aided.

11. A method according to claim 4 in which an intermediate image carrier onto which a portion of the colorant particles and a portion of the photo-polymerizable liquid are transferred is arranged between the potential image carrier and the recording medium.

12. A method according to claim 11 in which the transfer of the image film with the portion of the photo-polymerizable liquid onto the intermediate image carrier is assisted by an electrical field existing between the intermediate image carrier and the potential image carrier.

13. A method according to claim 1 in which a removal roller that is brought into contact with the photo-polymerizable liquid is used to reduce the photo-polymerizable liquid.

14. A method according to claim 13 in which an auxiliary potential is applied to the removal roller such that the colorant particles inking the potential image are repelled by the removal roller.

15. A method according to claim 13 in which the photo-polymerizable liquid is reduced by approximately 50% by the removal roller.

16. A method according to claim 1 in which, given multi-color printing, various color separations are successively applied to the potential image carrier and successively transferred onto the recording medium or an intermediate carrier.

17. A method according to claim 1 in which, in multi-color printing, color separations are collected on the potential image carrier and are subsequently transferred onto the recording medium or an intermediate carrier.

18. A method according to claim 1 in which the UV fixing is optimized via adjustment of a spectral distribution and power density of the radiation.

19. A method according to claim 18, in which a post-fixing with a UV radiation of a wavelength 200 to 280 nm is implemented when a hard surface of the print image is to be achieved.

20. A method according to claim 1 in which a radiation source is used for the fixing that radiates a combination of ultraviolet light, visible light and infrared radiant heat.

21. A method according to claim 20 in which a wavelength of the ultraviolet light lies in a range from 200 to 400 nm.

22. A method according to claim 21 in which a wavelength of the UV radiation is set from 320 to 400 nm when a greater penetration depth and a more significant volume effect in the recording medium is to be achieved.

23. A method according to claim 21 in which a wavelength of the UV radiation is selected from 280 to 320 nm when a smaller penetration depth and a more significant curing of the print image on the surface of the recording medium is to be achieved.

24. A method according to claim 21 in which a wavelength of the UV radiation is selected from 200 to 280 nm when a more significant curing of the surface of the print image on the recording medium is to be achieved.

25. A method according to claim 24 in which an inert gas is used when an intensified surface hardening is to be achieved.

26. A method according to claim 25 in which nitrogen is used as an inert gas.

27. A method according to claim 20 in which a wavelength of the visible light lies in a range from 400 to 700 nm.

28. A method according to claim 20 in which a wavelength of the radiant heat lies in a range from 700 nm to 10 μm.

29. A method according to claim 20 in which the radiation is adjusted such that the visible light and the radiant heat generate heat required for activation of the photo-polymerization and the UV radiation cures the photo-polymerizable liquid.

30. A method according to claim 20 in which a wavelength of the radiation is selected such that the print image is additionally provided with gloss and/or is additionally abrasion-resistant.

31. A method according to claim 20 in which the recording medium is exposed to a corona exposure before and/or after the UV curing.

32. A method according to claim 31 in which corona radiation, infrared radiation, visible light and UV radiation of a wavelength 320 to 400 nm is combined when a good liquefaction of the print image and a good bonding with a surface of the recoding medium is to be achieved with high surface gloss.

33. A method according to claim 1 in which a UV radiation is used to increase a viscosity of the image film.

34. A method according to claim 33 in which the image film is additionally exposed to a corona radiation.

35. A method according to claim 33 in which the viscosity increase of the image film is such that the transfer printing of the image film onto the recording medium occurs via contact pressure.

36. A method according to claim 1 in which a roller stamping follows given a UV pre-fixing with reduced power density.

37. An electrographic printer or copier device, comprising:

an imaging station at which potential images of images to be printed are generated on a potential image carrier;

a developer station at which to develop the potential images, a liquid developer is used that comprises a transparent photo-polymerizable carrier liquid and charged colorant particles suspended therein;

an applicator roller which transports the developer to the potential image carrier in a quantity that is substantially constant per time and area to form a developer film in a developing zone between the potential image carrier and the applicator roller for development of the potential images, the developer film adjacent to the potential image carrier comprising said photo-polymerizable carrier liquid enriched with said colorant particles in regions in which potential images are present on the potential image carrier and comprising said photo-polymerizable liquid substantially depleted of said colorant particles in regions in which no potential images are present, the developer film splitting at an end of the developing zone into an image film adhering to the potential image carrier comprising the developed potential image and a film adhering to the applicator roller, said film comprising said photo-polymerizable liquid with residual colorant particles;

a transfer station at which a portion of the image film with the developed potential images is transferred from the potential image carrier onto the recording medium such that the colorant particles and a portion of the photo-polymerizable liquid in which the colorant particles are arranged migrates from the image film; and a fixing station where the portion of the image film with the potential images to be developed is fixed on the recording medium with a UV radiation such that the colorant particles of the developed potential images are embedded in a solid, transparent polymer mass via photo-polymerization, and otherwise the photo-polymerizable liquid in the portion of the image film without the potential images is solidified into a transparent film.

38. A method for printing of a recording medium, comprising:

generating potential images on a potential image carrier;

to develop the potential images, using a liquid developer that comprises a transparent photo-polymerizable carrier liquid and charged colorant particles suspended therein;

transporting the developer via an applicator roller to the potential image carrier to form a developer film in a developing zone between the potential image carrier and the applicator roller for development of the images, the developer film adjacent to the potential image carrier comprising said photo-polymerizable carrier liquid enriched with said colorant particles in regions in which potential images are present on the potential image carrier and comprising said photo-polymerizable liquid substantially depleted of said colorant particles in regions in which no potential images are present, the developer film splitting at an end of the developing zone into an image film adhering to the potential image carrier comprising the developed potential images and a film adhering to the applicator roller;

transferring a portion of the image film with the developed potential images from the potential image carrier onto the recording medium such that the colorant particles and a portion of the photo-polymerizable liquid in which the colorant particles are arranged migrates from the image film; and fixing on the recording medium with a radiation a first part of the portion of the image film with the potential images to be developed such that the colorant particles of the developed potential images are embedded in a solid, transparent polymer mass via photo-poly, and in a second part of the portion of the image film without the potential images the photo-polymerizable liquid is solidified into a transparent film.

* * * * *